US006149462A

United States Patent [19]

Sugie

[11] Patent Number: 6,149,462

[45] Date of Patent: Nov. 21, 2000

[54] CONNECTOR HAVING AN EXCESSIVE DEFORMATION PREVENTION PLATE

[75] Inventor: Naoto Sugie, Shizuoka, Japan

[73] Assignee: Yazaki Corporation, Tokyo, Japan

[21] Appl. No.: 09/252,216

[22] Filed: Feb. 18, 1999

[30] Foreign Application Priority Data

Feb. 20, 1998 [JP] Japan ..... 10-039440

[51] Int. Cl.[7] ..... H01R 13/40; H01R 13/514

[52] U.S. Cl. ..... 439/595; 439/752

[58] Field of Search ..... 439/595, 744, 439/598, 752

[56] References Cited

U.S. PATENT DOCUMENTS 5,181,862 1/1993 Hawk et al. ..... 439/595
5,397,249 3/1995 Endo et al. ..... 439/595

FOREIGN PATENT DOCUMENTS 5-31138 4/1993 Japan .
5-41068 6/1993 Japan .
9-283203 10/1997 Japan .

*Primary Examiner*—Brian Sircus
*Assistant Examiner*—Chandrika Prasad
*Attorney, Agent, or Firm*—Sughrue, Mion, Zinn, Macpeak & Seas, PLLC

[57] ABSTRACT

A locking arm (35) engages with a terminal (26) inserted into a terminal storage chamber (23) of a housing (21) thereby to prevent the terminal (26) from being come out therefrom. A front holder (22) is slid to the housing (21) from the front side of the housing (21) and attached to the housing (21), whereby an excessive deformation prevention plate (45) of the front holder (22) covers the outside of the locking arm (35) thereby to prevent the excessive deformation of the locking arm (35). The housing (21) is provided with an insertion hole (39) which slidably receives the tip portion (45*a*) of the excessive deformation prevention plate (45) therein and supports the tip portion, whereby the deformation of the excessive deformation prevention plate is prevented.

12 Claims, 14 Drawing Sheets

PRIOR ART FIG. 17
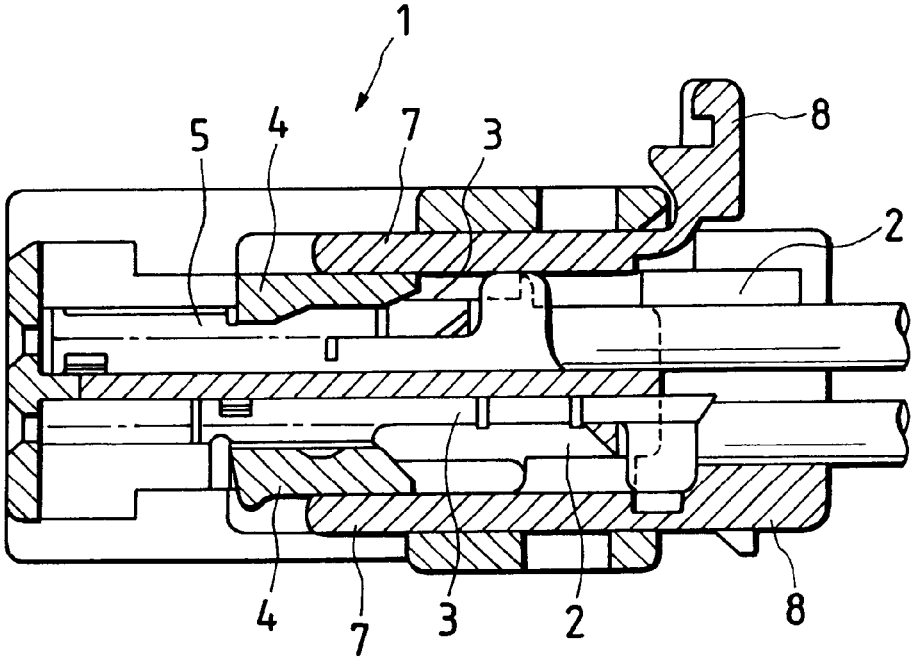
PRIOR ART FIG. 18
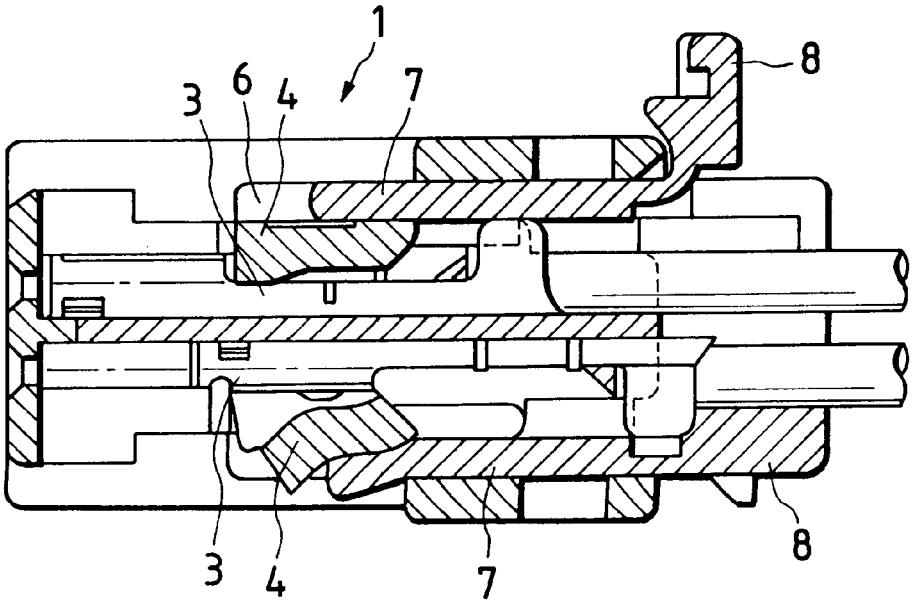

CONNECTOR HAVING AN EXCESSIVE DEFORMATION PREVENTION PLATE

BACKGROUND OF THE INVENTION

1. Field of the Invention

The present invention relates to a connector which is arranged to prevent detachment of a terminal from a terminal storage chamber by having a locking arm which engages the terminal inserted within the terminal storage chamber.

2. Related Art

A conventional connector having a locking arm (lance) for preventing a terminal from being come out is disclosed in JP-A-9-283203, JU-A-5-31138, JU-A-5-41068, or the like.

FIGS. 16 to 18 show the arrangement of such a conventional connector, wherein terminal storage chambers 2 for receiving terminals 3 therein are formed and aligned in a housing 1. Each of the terminal storage chambers 2 is provided with a locking arm 4 which engages with the terminal 3 inserted within the chamber. As shown in FIG. 17, the locking arm 4 is arranged to engage with the rear side of the contact portion 5 of the terminal 3 thereby preventing the terminal 3 from coming out from rear side of the housing 1.

In such a connector, in order to bend the locking arm 4 to the direction opposite to the engaging direction with the terminal 3, that is, to the outside direction of the housing 1, an opening portion 6 in an opened state is formed at the portion forming the locking arm 4 in the housing 1. In other words, the opening portion is formed so that the locking arm 4 can be bent outside to release the engagement of the locking arm 4 with the terminal 3 thereby making it possible to extract the terminal 3 from the housing 1. This opening portion 6 is normally covered by a cover (not shown) attached to the housing 1.

If the locking arm 4 is bent to a greater extent than needed, the locking arm 4 may be deformed or broken. In order to prevent such a phenomenon, an excessive deformation prevention plate 7 for preventing the excessive deformation of the locking arm 4 is provided. The excessive deformation prevention plate 7 is provided which is slidable within the housing 1 and arranged in a manner that the tip portion thereof serving as a free end covers the locking arm 4 thereby preventing the excessive deformation of the locking arm 4. An operation portion 8 extracted outside of the housing 1 is provided at the excessive deformation prevention plate 7 so as to continue therefrom. The excessive deformation prevention plate 7 can be moved backward by rotating the operation portion 8, whereby the bending operation of the locking arm 4 becomes possible.

However, in the conventional connector, if an excessive stress is applied to the locking arm 4 in the case of bending the locking arm in order to extract the terminal 3, both the locking arm 4 and the excessive deformation prevention plate 7 may be bent excessively outside as shown in FIG. 18. This is because the tip portion of the excessive deformation prevention plate 7 is arranged to be a free end. If the locking arm is bent excessively, since the locking arm 4 may be deformed or broken (see the lower locking arm 4 in FIG. 18), there arises a problem that a terminal holding mechanism for locking the terminal 3 may be broken and the terminal 3 may be accidentally come out of the housing 1.

In order to prevent such an excessive deformation of the excessive deformation prevention plate 7, it is proposed to provide a member for pressing the excessive deformation prevention plate 7. However, in this case, since the number of the parts increases, there arises a new problem that the arrangement of the connector becomes complicated, the size thereof becomes large and further the fabrication thereof becomes difficult.

SUMMARY OF THE INVENTION

An object of the present invention is to provide a connector capable of surely preventing the excessive deformation of an excessive deformation prevention plate even when the connector has a simplified arrangement not necessary for providing any new member.

In order to achieve the aforesaid object there is provided a connector in which a locking arm engages with a terminal inserted into a terminal storage chamber of a housing thereby preventing the terminal from detaching therefrom, and a front holder is slid into the housing from a front side of the housing and attached to the housing, whereby an excessive deformation prevention plate of the front holder covers an outside of the locking arm thereby preventing an excessive deformation of the locking arm, the connector is provided in that the housing is provided with an insertion hole which slidably receives a tip portion of the excessive deformation prevention plate therein and supports the excessive deformation prevention plate.

According to the present invention, since the tip portion of the excessive deformation prevention plate is inserted into the insertion hole of the housing, the tip portion of the excessive deformation prevention plate serving as a free end is supported by the insertion hole. Thus, even if an excessive stress is applied to the locking arm at the time of bending the locking arm, the excessive deformation prevention plate can surely prevent the excessive deformation of the locking arm without being deformed. Accordingly, the locking arm can perform the terminal holding function stably without being deformed or broken even if the connector has a simplified arrangement not necessary for providing any new member.

Further, since the insertion hole is arranged to slidably receive the excessive deformation prevention plate therein, it is possible to move the excessive deformation prevention plate backward, so that it becomes possible to perform the bending operation with respect to the locking arm in accordance with the backward movement of the excessive deformation prevention plate. Thus, the terminal can be extracted from the housing without any trouble.

According to another aspect of the present invention, the front holder slides from a provisionally locking position to a formally locking position thereby becoming attached to the housing, and the tip portion of the excessive deformation prevention plate is inserted into the insertion hole only after the front holder is positioned at the provisionally locking position.

In the present invention, since the excessive deformation prevention plate is inserted into the insertion hole only after the front holder is positioned at the provisionally locking position, the deformation of the excessive deformation prevention plate can be prevented during the period from the start of the sliding operation of the front holder to the termination thereof. Further, in the case of extracting the terminal by bending the locking arm when the front holder is positioned at the provisionally locking position, since the excessive deformation prevention plate is supported by the insertion hole, the excessive deformation of both the excessive deformation prevention plate and the locking arm can be prevented even if an excessive stress is applied thereto.

In the present invention, there is provided that the front holder is formed in a U-shape by including an upper and lower wall portions each of which is formed by the excessive deformation prevention plate and a terminal pressing plate for pressing the terminal within the terminal storage chamber and by including a front wall portion for covering a front face of the housing, the front holder further includes guide ribs at both sides of each of the upper and lower wall portions, and the guide ribs are slidably inserted into guide grooves provided at the housing, respectively.

The front holder is formed in a U-shape by continuously coupling the upper and lower wall portions and the front wall portion and the excessive deformation prevention plates form a part of the upper and lower wall portions of the front holder, so that excessive deformation prevention plates are provided with sufficient strength. Further, since the guide ribs provided at both sides of each of the upper and lower wall portions slide along the guide grooves, the upper and lower wall portions are supported by the housing at both sides thereof. Thus, the excessive deformation prevention plates as a part of the upper and lower wall portions are stiffly supported by the housing and hence prevented from being deformed to the more extent than needed even if an excessive stress is applied thereto.

According to the present invention, there is provided that the front holder is provided with a sliding arm which couples the excessive deformation prevention plates of the upper and lower wall portions and slides along an outer wall of the housing.

In the present invention, since the sliding arm couples the upper and lower wall portions, the upper and lower wall portions are provided with sufficient strength. Thus, the excessive deformation prevention plates as a part of the upper and lower wall portions are also provided with sufficient strength and hence prevented from being deformed to the more extent than needed.

BRIEF DESCRIPTION OF DRAWINGS

FIG. 17 is a cross sectional view showing the conventional connector; and

FIG. 18 is a cross sectional view of the conventional connector.

DETAILED DESCRIPTION OF PREFERRED EMBODIMENTS

Figure 3:
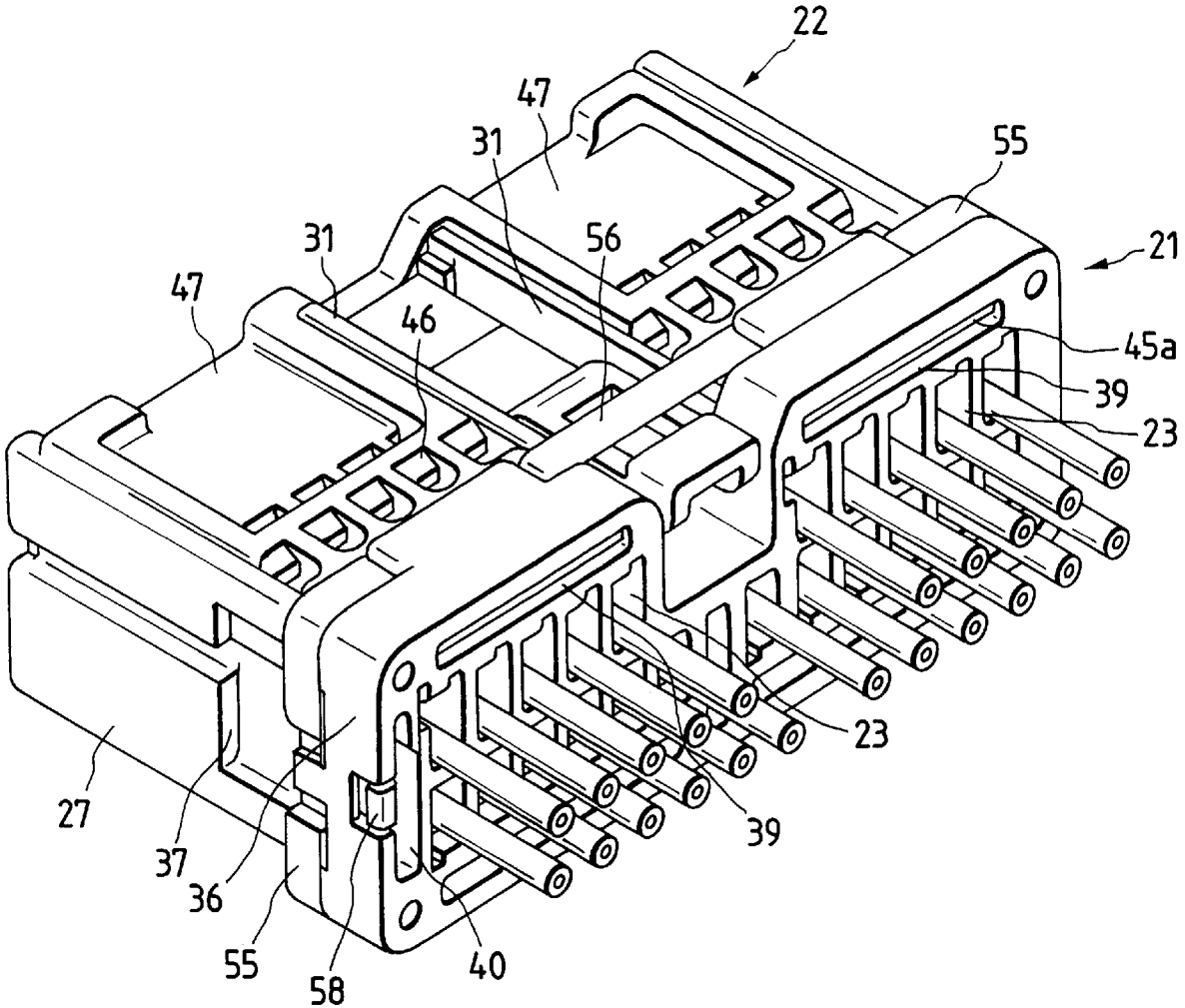
FIG. 3 is a perspective view of the connector according to the embodiment of the present invention showing the formally locking state of the front holder thereof seen from the rear side thereof.
Figure 4:
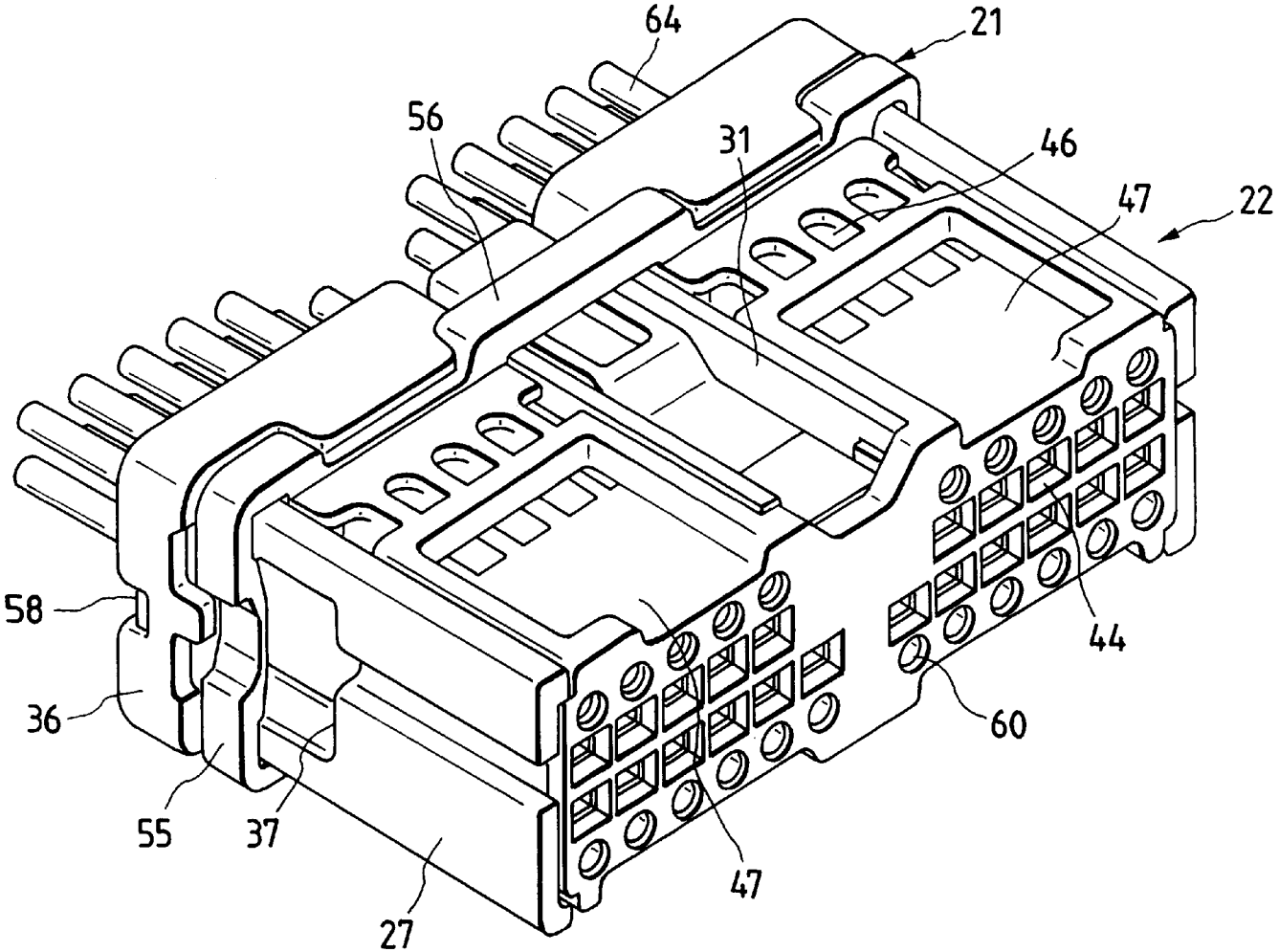
FIG. 4 is a perspective view of the front holder showing the formally locking state thereof seen from the front side thereof in the connector according to the embodiment of the present invention.
Figure 13:
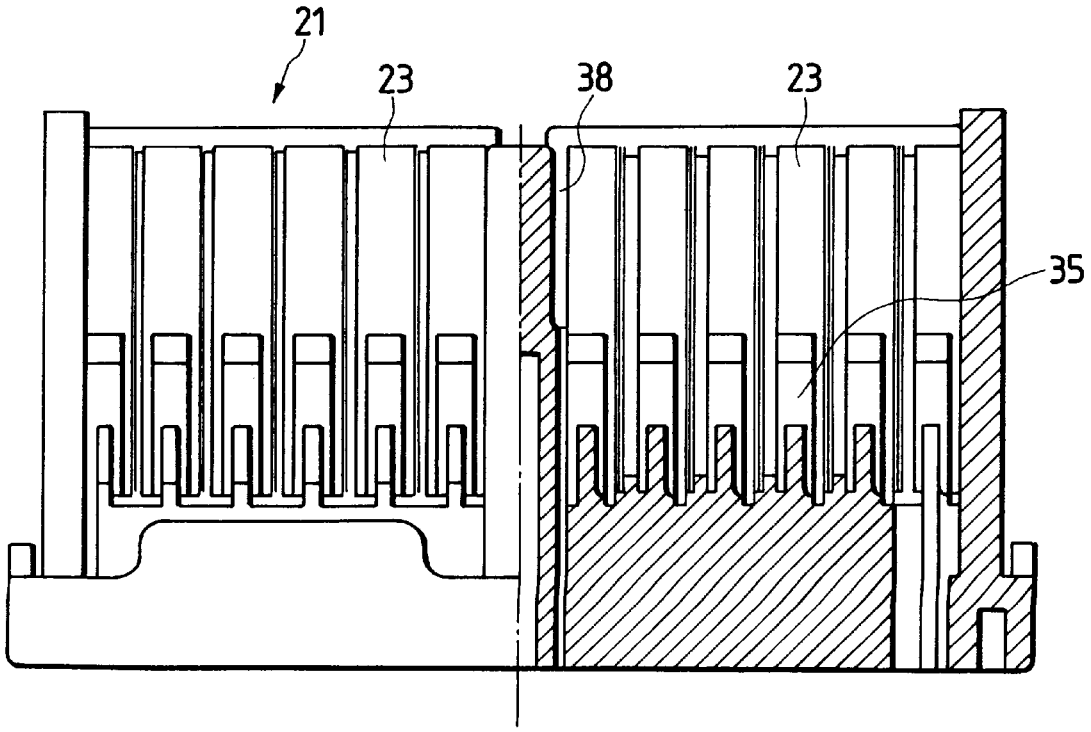
FIG. 13 is a partially cutaway front view of the housing of the connector according to the embodiment of the present invention showing a housing thereof.
Figure 14:
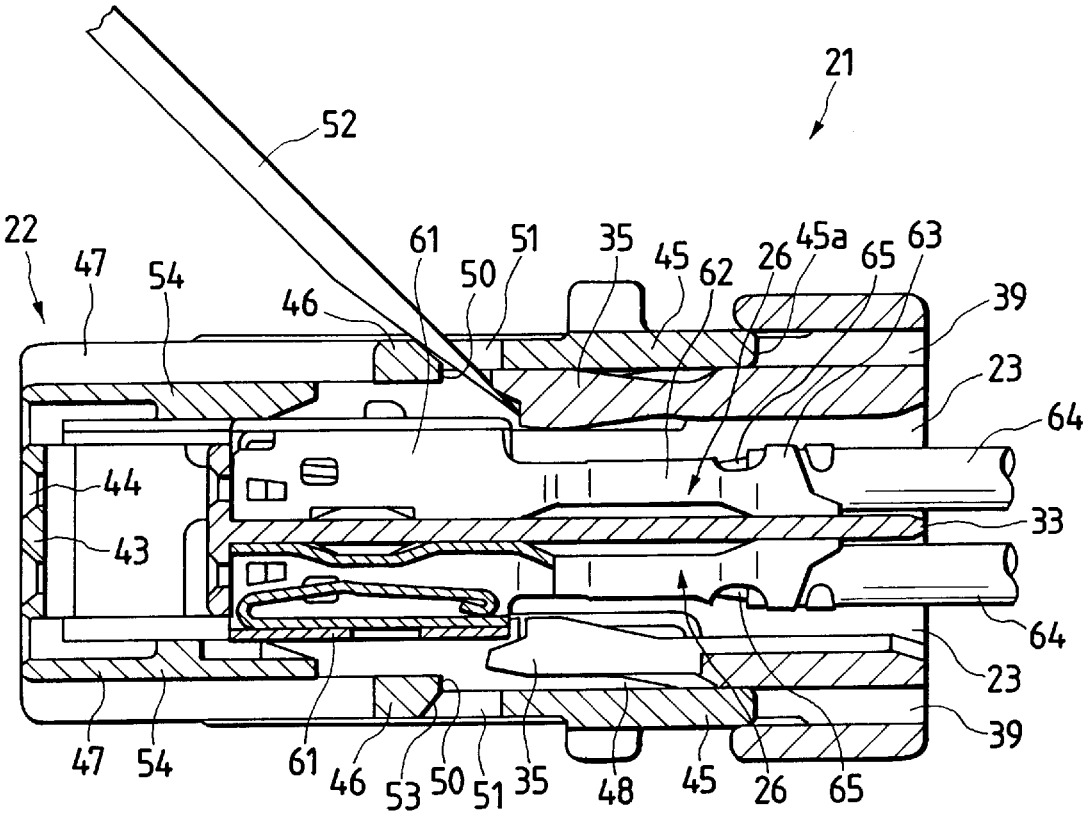
FIG. 14 is a longitudinal sectional view of the connector according to the embodiment of the present invention showing the provisionally locking state of the front holder thereof.
Figure 15:
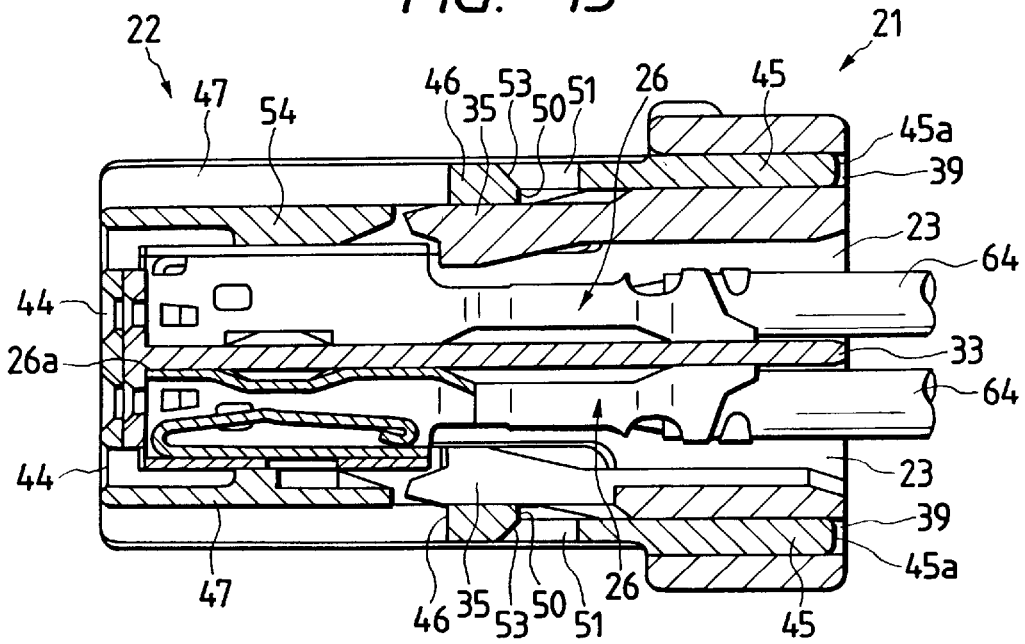
FIG. 15 is a longitudinal sectional view of the connector according to the embodiment of the present invention showing the formally locking state of the front holder thereof.
Figure 16:
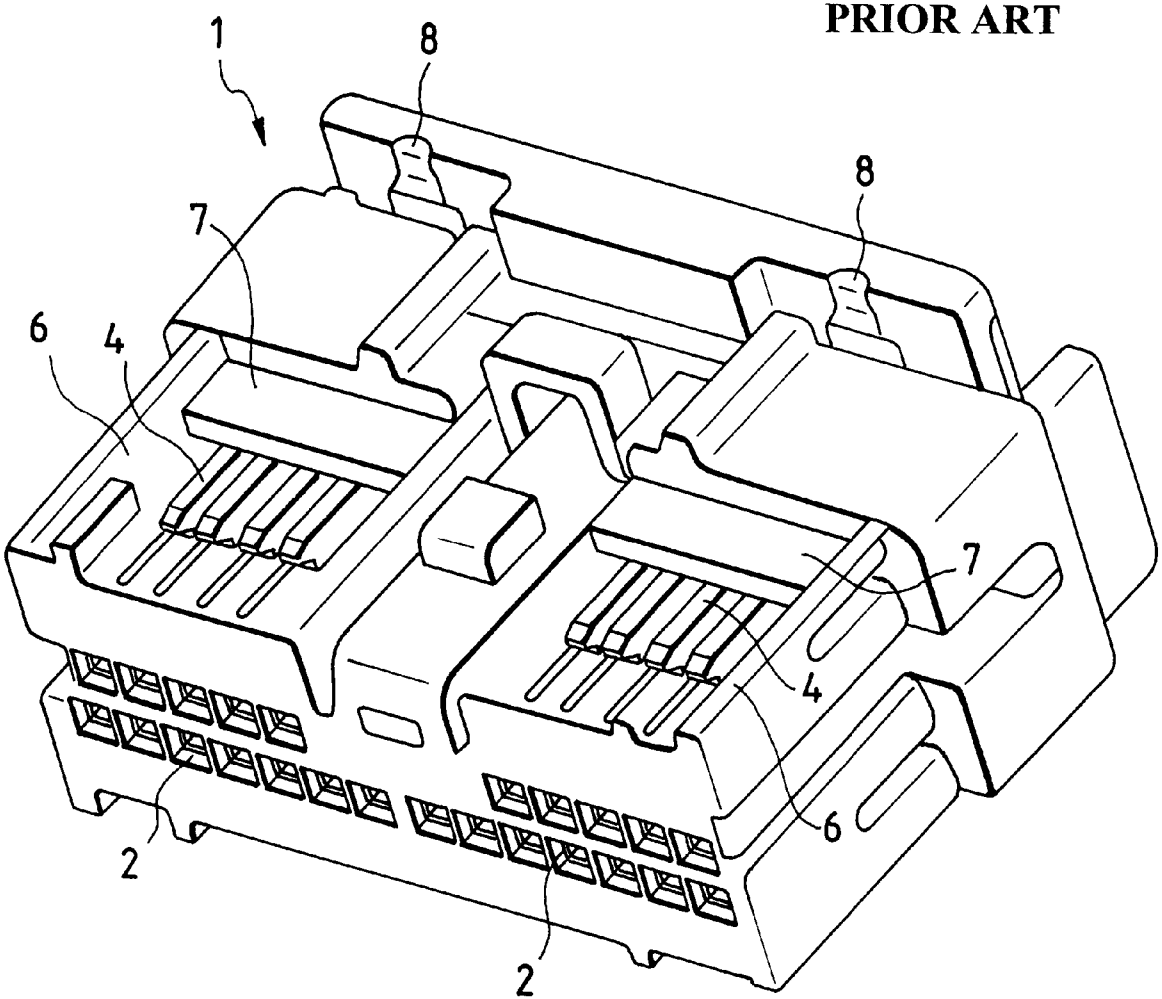
FIG. 16 PRIOR ART
FIG. 16 is a perspective view showing a conventional connector.

An embodiment of the present invention will be described with reference to FIGS. 1 to 15. The connector according to the embodiment is formed by a housing 21 and a front holder 22. The front holder 22 is arranged to move slidably from a provisionally locking position to a formally locking position. FIGS. 1, 2, 9 and 14 show the state that the front holder 22 is positioned at the provisionally locking position with respect to the housing 21, while FIGS. 3, 4 and 15 show the state that the front holder 22 is positioned at the formally locking position with respect to the housing 21.

Figure 5:
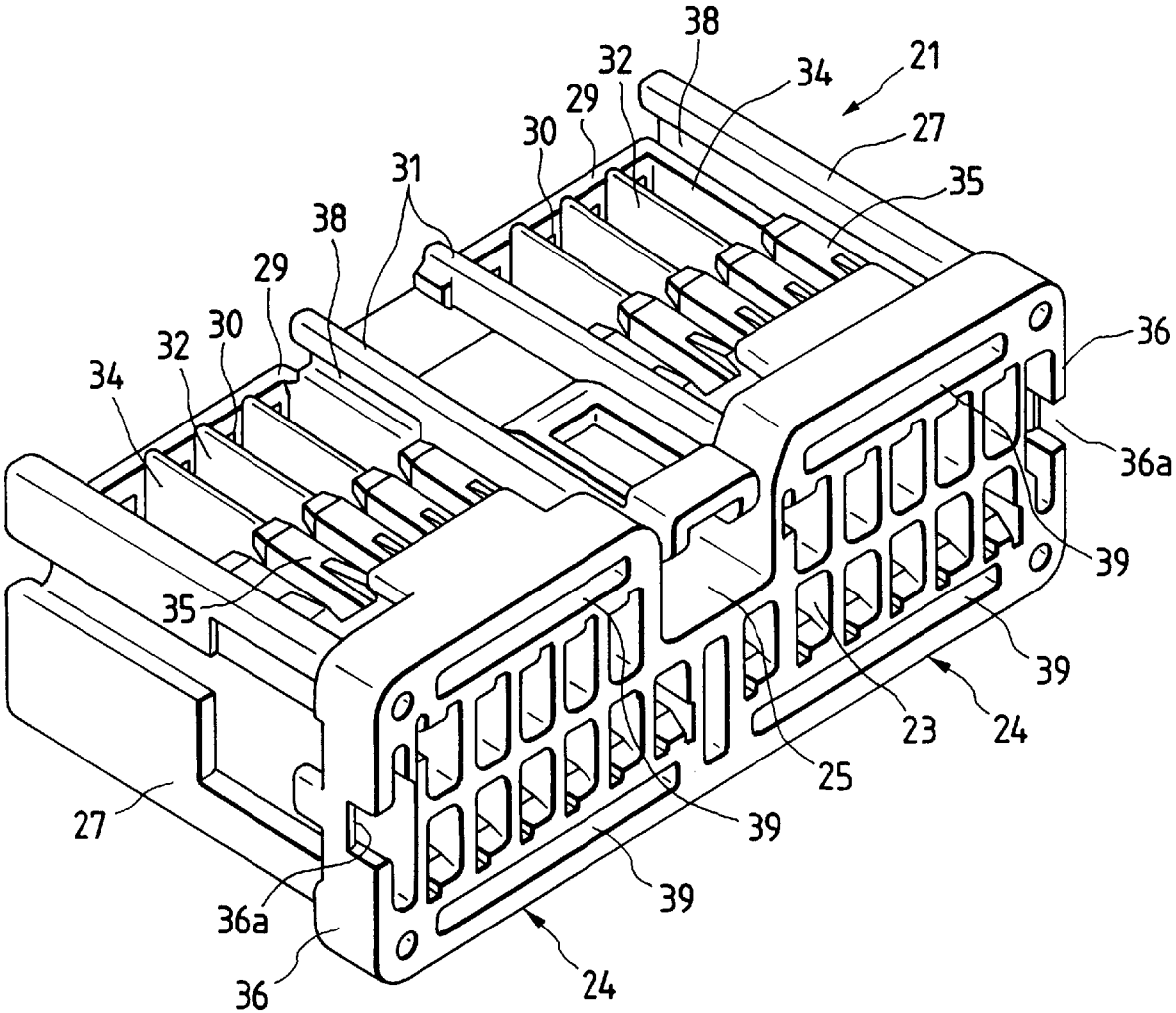
FIG. 5 is a perspective view of a housing seen from the rear side thereof in the connector according to the embodiment of the present invention.
Figure 6:
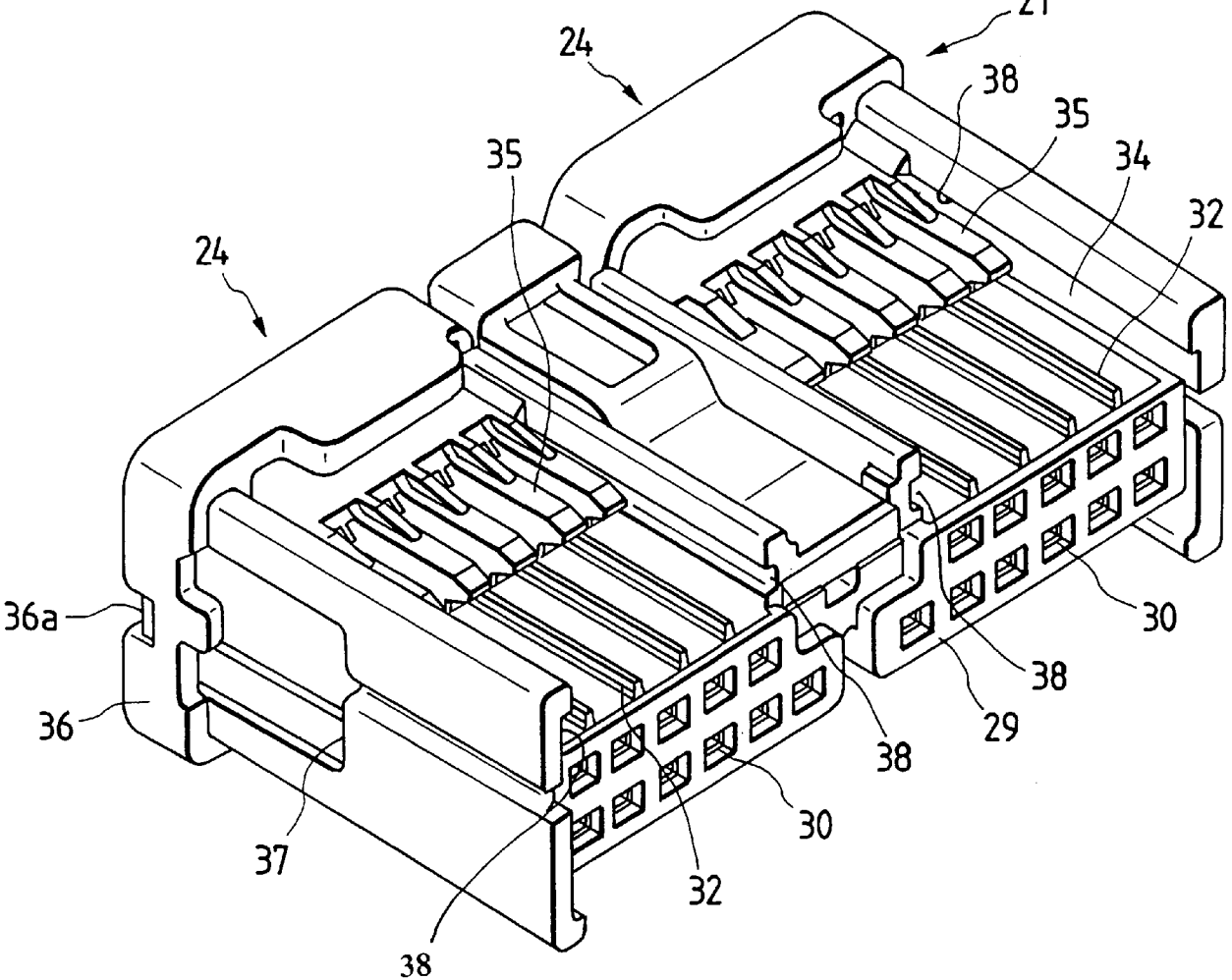
FIG. 6 is a perspective view of the housing seen from the front side thereof in the connector according to the embodiment of the present invention.
Figure 12:
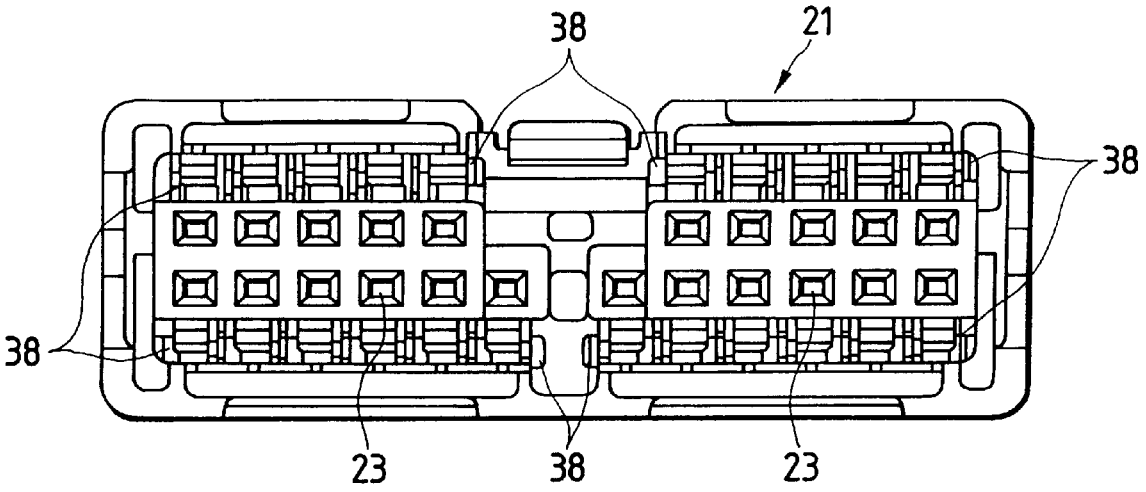
FIG. 12 is a front view of the housing of the connector according to the embodiment of the present invention.

FIGS. 5 and 6 are diagrams showing the housing 21 seen from the rear and front sides thereof, respectively. FIGS. 12 and 13 show the front view and the transversal sectional view of the housing 21, respectively. The housing 21 includes left and right block bodies 24, 24 having terminal storage chambers 23 into which terminals 26 are inserted and further includes a coupling block 25 for coupling these left and right block bodies 24, 24. Each of the left and right block bodies includes five terminal storage chambers 23 aligned at the upper stage and six terminal storage chambers 23 aligned at the lower stage. The housing 21 further includes left and right outer side wall portions 27, 27 and inner side wall portions 31, 31 provided along the longitudinal direction of the left and right block bodies 24, 24, and furthermore includes a rear wall portion 28 for continuously coupling the left and right block bodies 24, 24 and the coupling block 25 at the rear side of the housing. The outer side wall portions 27, 27 and the rear wall portion 28 form the outer walls of the housing 21. The housing 21 is further provided with a front wall portion 29 at the front face side thereof. The front wall portion 29 is provided with communication holes 30 being opened and respectively corresponding to the terminal storage chambers 23.

The terminal storage chambers 23 of the block bodies 24, 24 are independently separated by partitioning wall portions 32 each for partitioning the terminal storage chambers 23 disposed adjacently to the horizontal direction together with an intermediate wall portion 33 for partitioning the block bodies 24, 24 into upper and lower sections, so that the terminals 26 inserted into the adjacent terminal storage chambers 23 are prevented from contacting to each other. The upper and lower face portions of the block bodies 24, 24 are opened to form opened portions 34 which are covered by the front holder 22 described later.

Each of the terminal storage chambers 23 is provided with a locking arm 35. The locking arm 35 extends from the rear wall portion 28 to the forward side and the tip portion thereof is formed to be a free end, so that the locking arm is elasticity capable of being bent and deformed. As shown in FIG. 14, terminal the locking arm 35 engages with the terminal 26 inserted into the terminal storage chamber 23 thereby preventing the terminal 26 from coming out from rear side of the housing 21.

A locking frame 36 is formed at each of the left and right end portions of the rear wall portion 28 of the housing 21. Each of the locking frames 36 extends to the vertical direction and the upper and lower end portions thereof are continued to and integrated with the rear wall portion 28 thereby to form a closed loop having a through hole 40 between the locking frame and the rear wall portion 28. A front holder locking arm 57 of the front holder 22 passes through the through hole 40.

The locking arm 57 of the front holder 22 engages with the locking frame 36 thereby to fix the front holder 22 at the formally locking position. In order to perform such an locking operation, a locking groove 36*a* for engaging with the locking arm 57 is formed in the locking frame 36.

At a portion of the outer side wall portion 27 of the housing 21 in the front side of each of the locking frames 36, an abutment portion 37 is formed which protrudes in a step-fashion to the outside. The abutment portion 37 fixes the front holder 22 at the provisionally locking position thereby to prevent the front holder 22 from being drawn back from the provisionally locking position.

Guide grooves 38 for guiding the sliding operation of the front holder 22 are formed at the outer side wall portions 27 and the inner side wall portions 31. Further, at each of the upper and lower portions of the rear wall portion 28, insertion holes 39 are formed into which the tip portions of the excessive deformation prevention plates 45 of the front holder 22 are slidably inserted.

Figure 7:
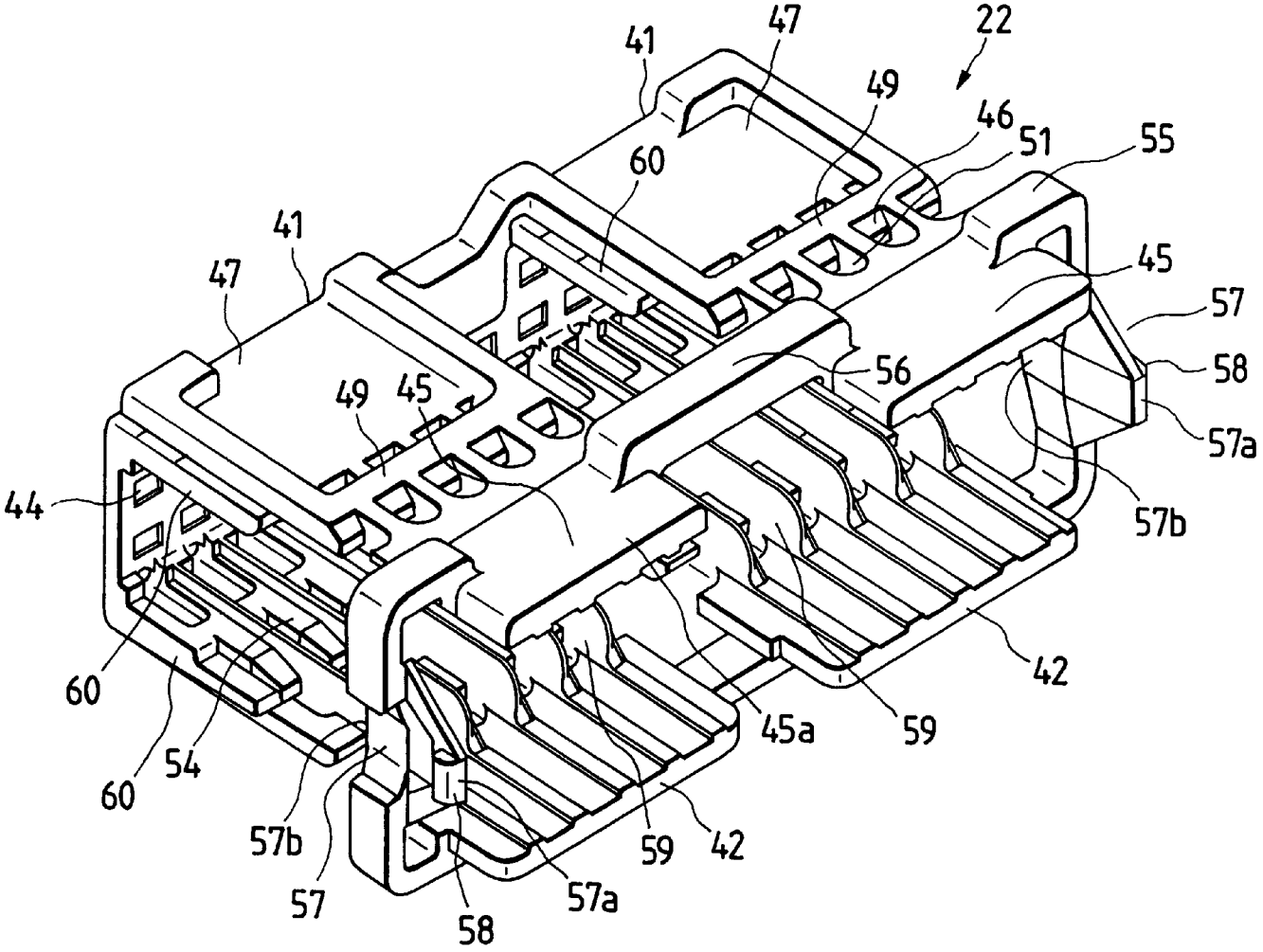
FIG. 7 is a perspective view of the front holder seen from the rear side thereof in the connector according to the embodiment of the present invention.
Figure 8:
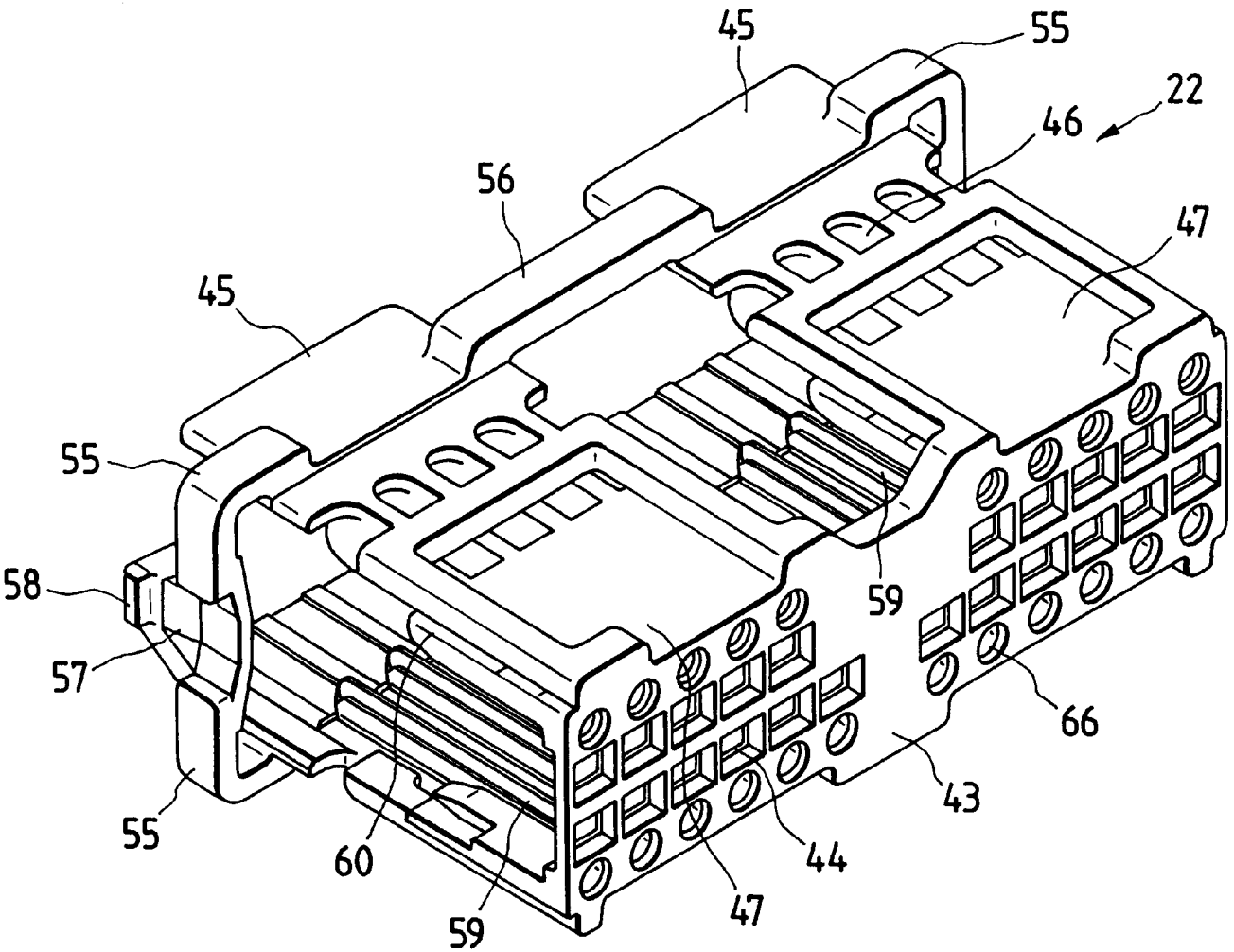
FIG. 8 is a perspective view of the front holder seen from the front side thereof in the connector according to the embodiment of the present invention.
Figure 9:
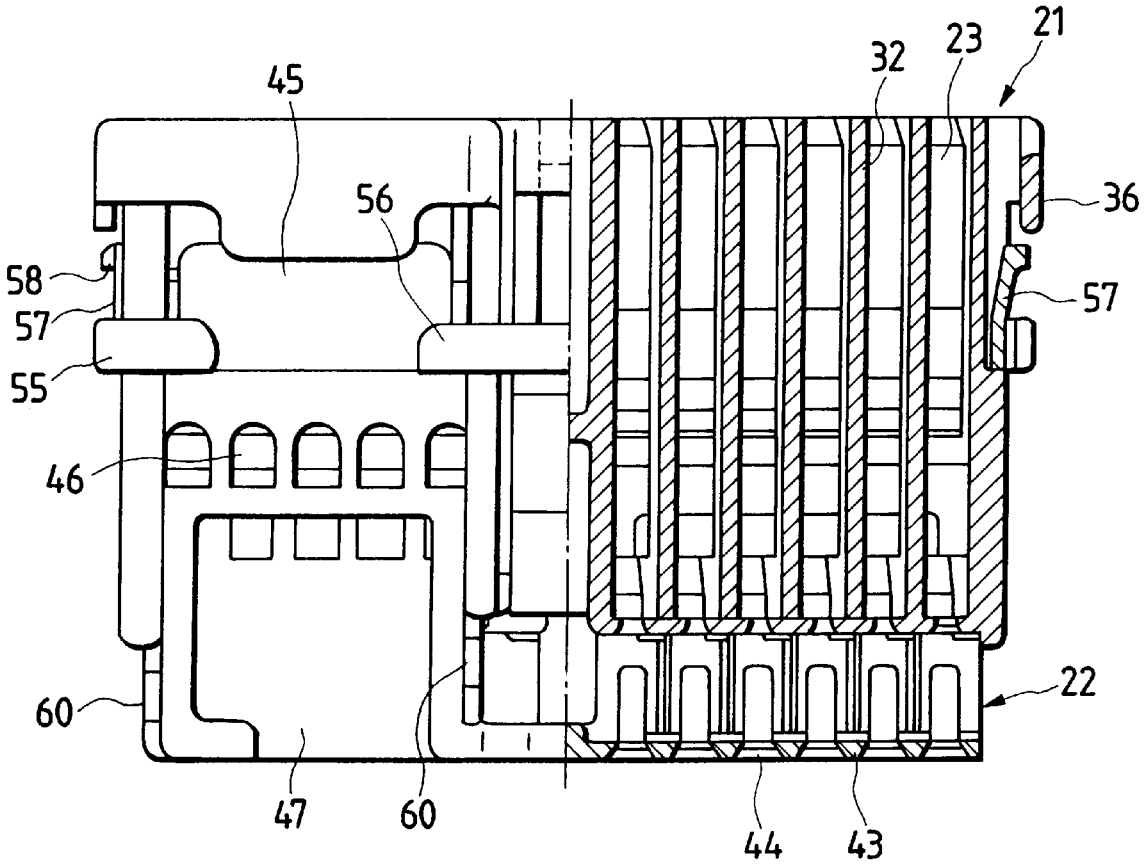
FIG. 9 is a transversal sectional view of the connector according to the embodiment of the present invention showing the provisionally locking state of the front holder thereof.
Figure 10:
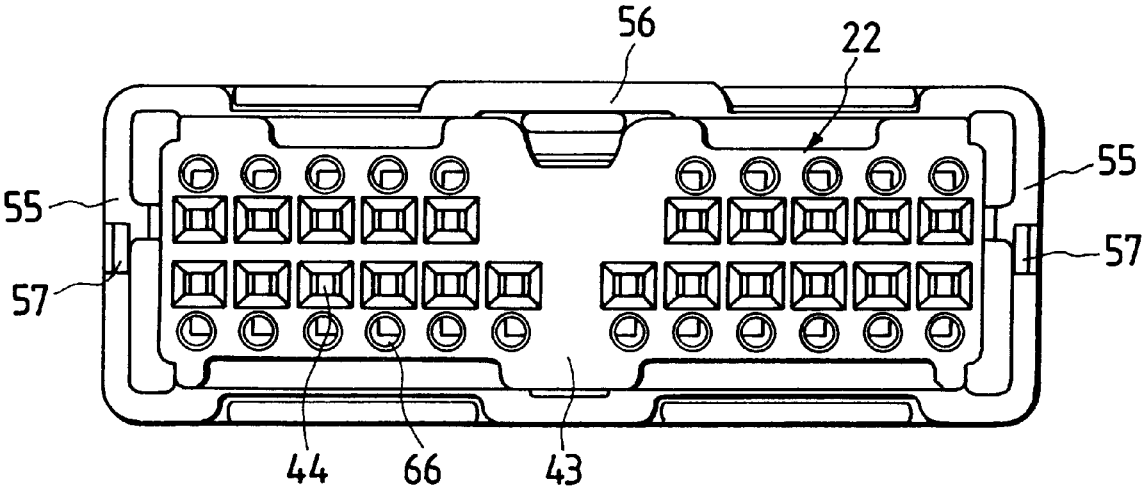
FIG. 10 is a front view of the front holder showing the provisionally locking state thereof seen from the front side thereof in the connector according to the embodiment of the present invention.
Figure 11:
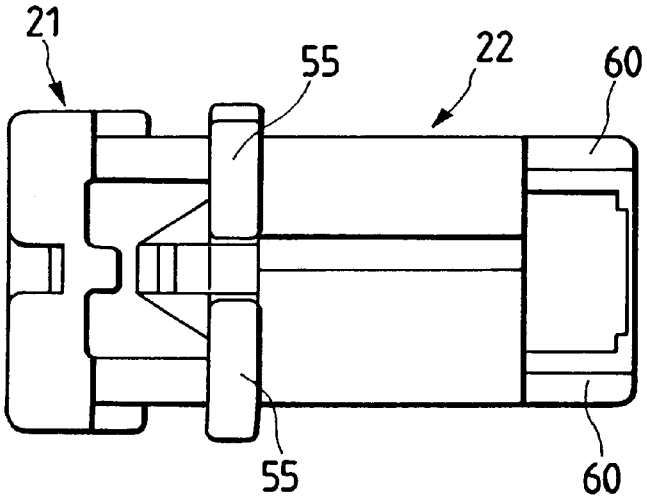
FIG. 11 is a side view of the connector according to the embodiment of the present invention showing the provisionally locking state of the front holder thereof.

FIGS. 7 and 8 show the front holder 22 seen from the rear side and the front side, respectively. The front holder 22 includes upper wall portions 41 and lower wall portions 42 disposed in parallel, and further includes a front wall portion 43 extending vertically and coupling at the front face side these upper and lower wall portions 41, 42. The front holder 22 is opened at the left and right side faces and the rear face thereof, so that the front holder is formed in a U-shape when seen from the side wall side thereof. The upper wall portions 41 and the lower wall portions 42 serve to cover the upper and lower opened portions 34 of the block bodies 24 of the housing 21. To this end, left and right upper wall portions 41 and the left and right lower wall portions 42 are provided in correspondence with the left and right block bodies 24 of the housing 21, respectively.

In the state where the front holder 22 is attached to the housing 21, partner-side terminals (not shown) are inserted into the terminal storage chambers 23 from the front wall portion 43 of the front holder 22. To this end, the front wall portion 43 is provided with terminal insertion holes 44 which are opened and respectively corresponding to the terminal storage chambers 23 of the housing 21. As shown in FIGS. 2 and 8, detection pin insertion holes 66 are formed in the vicinity of the terminal insertion holes 44, respectively. A detection pin (not shown) for performing the conduction inspection or the like of the terminal 26 is inserted into the detection pin insertion hole 66.

Each of the upper and lower wall portions 41, 42 is formed by sequentially and continuously providing the excessive deformation prevention plate 45, detection plate 46 and terminal pressing plate 47.

The excessive deformation prevention plates 45 are positioned at the housing 21 side of the front holder, that is, the most rear side of the front holder. The excessive deformation prevention plates 45 serve to prevent the excessive deformation of locking arms 35 of the housing 21. FIG. 14 shows a state where the front holder 22 is stopped at the provisionally locking position. When the front holder 22 is located at the provisionally locking position, the excessive deformation prevention plates 45 are in a state of covering the outside of the locking arms 35 of the housing 21.

In this case, the excessive deformation prevention plates 45 covers the locking arms 35 in a manner that a bending deformation space 48 is formed between the excessive deformation prevention plates 45 and the locking arms 35, whereby the locking arms 35 can be bent and deformed out. Thus, as shown in FIG. 14, when the front holder 22 is located in the provisionally locking position, it is possible to insert a drawing jig 52 within the housing 21 to bend the locking arm 35 out. As a consequence, the engagement of the locking arm 35 with the terminal 26 can be released, so that the terminal 26 can be extracted from the housing 21.

The detection plates 46 are provided between the excessive deformation prevention plates 45 and the terminal pressing plates 47. In this embodiment, each of the upper wall portions 41 and the lower wall portions 42 is provided with a rib 49 which protrudes in a step-fashion from the terminal pressing plate 47. Each of the detection plates 46 is formed so as to protrude from the rib 49 toward the excessive deformation prevention plate 45. The detection plates 46 are formed to protruded from the rib 49 in this manner so as to correspond to the terminal storage chambers 23 of the housing 21, respectively.

The detection plates 46 are integrally formed with the excessive deformation prevention plate 45, and the detection plates 46 protrude towards the locking arms 35 of the housing 21 relative to the excessive deformation prevention plate 45, as shown in FIG. 14. That is, the detection plate 46 has a step portion 50 protruding to the locking arm 35 side relative to the excessive deformation prevention plate 45, whereby it can be detected by the presence of the step portion 50 whether or not the terminal 26 is completely inserted into the terminal storage chamber 23. This detection is performed depending on whether or not the detection plate 46 abuts against the locking arm 35.

An opening window portion 51 is formed between the detection plate 46 and the excessive deformation prevention plate 45 so that the drawing jig 52 can be inserted within the housing through the opening window portion 51. A tapered surface 53 is formed on the surface of the detection plate 46 facing on the opening window portion 51 and slanted towards the locking arm 35 so that the tapered surface guides the drawing jig 52 therealong.

The terminal pressing plate 47 protrudes within the housing 21 in a manner that it locates at a lower position than the detection plate 46. Pressing projections 54 are respectively formed in correspondence with the terminal storage chambers 23 on the housing 21 side of each of the terminal pressing plates 47. The pressing projection 54 acts to press the terminal 26 towards the terminal storage chamber 23, that is, towards the intermediate wall portion 33 (see FIG. 5), whereby the terminal 26 can be fixed without wobbling.

Since such a terminal pressing plate 47 is arranged that its pressing projections 54 surely press the terminals 26, the terminals 26 can be fixed stably. If the terminal 26 is not fixed. stably, the tip end 26*a* of the terminal 26 is exposed from the terminal insertion hole 44 and hence the partner-side terminal inserted from the terminal insertion hole 44 collides with the tip end 26*a,* so that good contact between the terminal 26 and the partner-side terminal can not be performed. However, in the present embodiment, since the terminal pressing plate 47 fixes the terminal 26 stably, the tip end 26*a* of the terminal 26 is prevented from being exposed from the terminal insertion hole 44 as shown in FIG. 15, so that good contact between the terminal 26 and the partner-side terminal can be performed.

Guide ribs 60 are formed at both sides of the terminal pressing plate 47 in each of the upper and lower wall portions 41, 42. Guide grooves 38 into which the guide ribs 60 are slidably inserted are formed in the housing 21. The tip side of each of the guide ribs 60 inclines toward the direction away from the terminal pressing plate 47 and laps on the guide groove 38. Thus, the wobbling between the front holder 22 and the housing 21 can be prevented by sliding the guide ribs 60 along the guide grooves 38. As a result, there does not appear more clearance than needed between the terminals 26 and the terminal pressing plate 47 (that is, a clearance necessary for performing good contact between male and female terminals) and so the tip portions of the terminals 26 are prevented from being exposed from the insertion holes 39.

The excessive deformation prevention plates 45 of the upper and lower wall portions 41, 42 are coupled by a sliding arm 55 and also the excessive deformation prevention plates 45 disposed adjacently to the longitudinal or horizontal direction are coupled by a coupling arm 56. The sliding arms 55 are slidable along the outer side wall portions 27 of the housing 21, and the front holder 22 slides from the provisionally locking position to the formally locking position in accordance with the sliding of the sliding arms 55.

A locking arm 57 is integrally formed with the sliding arm 55 at the center portion thereof. The locking arm 57 is formed in a trapezoidal-shape when seen form the side wall side and the top side portion 57*a* thereof is positioned at the housing 21 side. A locking projection 58 for engaging with the locking frame 36 of the housing 21 protrudes from the top side portion 57*a*. The locking projection 58 engages with the locking groove 36*a* of the locking frame 36 when the front holder 22 slides to the formally locking position, whereby the front holder 22 can be fixed at the formally locking position according to this engagement.

The bottom side portion 57*b* of the locking arm 57 serves as a stopper portion 57*b* which abuts against the abutment portion 37 formed at the outer side wall portion 27 of the housing 21. According to such an abutment of the stopper portion 57*b* against the abutment portion 37, the front holder 22 is prevented from being returned from the provisionally locking position.

On the housing 21 side of the upper and lower wall portions 41, 42 of the front holder 22, partitioning plate portions 59 are provided to extend vertically with respect to the upper and lower wall portions 41, 42 in correspondence with the partitioning wall portions 32 of the housing 21, respectively, whereby the terminal storage chambers 23 are partitioned by the partitioning plate portions 59 together with the partitioning wall portions 32.

The terminals 26 are formed by subjecting a conductive metal plate to the punching pressing process. As shown in FIG. 14, each of the terminals 26 includes a contact portion 61, a connection portion 62 and a caulking portion 63 along the longitudinal direction thereof. The contact portion 61 serves to perform electrical conduction to the partner-side terminal when the partner-side terminal is inserted and contacts to the contact portion 61. The connection portion 62 serves to connect the terminal to a covered wire 64 when caulks the core wire 65 of the covered wire 64. The caulking portion 63 serves to fix the covered wire 64 when caulks the covered wire 64. In this embodiment, the aforesaid locking arm 35 engages with the rear side of the contact portion 61.

Then the explanation will be made as to the supporting structure and the strength application structure of the excessive deformation prevention plate 45 in this embodiment.

Each of the excessive deformation prevention plates 45 is formed in a flat plate shape and the tip portion 45*a* thereof is formed to be a free end. The insertion holes 39 of the housing 21 are formed in correspondence with the tip portions 45*a*. The insertion holes 39 are formed to be disposed at upper and lower positions of the rear wall portion 28 in each of the block bodies 24 of the housing 21 and adapted to slidably receive the tip portions 45*a* of the corresponding excessive deformation prevention plates 45 therein, respectively. Since the excessive deformation prevention plate 45 is supported by being inserted at the tip portion 45*a* thereof into the insertion hole 39, the excessive deformation prevention plate 45 is placed in a state being prevented from being bent and deformed even if the tip portion 45*a* is a free end. Thus, even if a stress applied to the locking arm 35 for bending it outside is large at the time of extracting the terminal 26, the excessive deformation prevention plate 45 is prevented from being bent. Accordingly, since the excessive deformation of the locking arm 35 is also prevented, the locking arm 35 can surely lock the terminal 26.

The inserting operation of the excessive deformation prevention plate 45 into the insertion hole 39 is performed from the state where the front holder 22 is located at the provisionally locking position and continued to the state where the front holder 22 reaches the formally locking position. To this end, since the excessive deformation prevention plate 45 is supported by the insertion hole 39 when the front holder 22 is attached to the housing 21, the excessive deformation prevention plate 45 is prevented from being deformed. In particular, when the front holder 22 is situated in the provisionally locking position, the operation for bending the locking arm 35 out is performed in order to extract the terminal 26. During this operation, since the tip portion 45*a* of the excessive deformation prevention plate 45 is supported by the insertion hole 39, the excessive deformation prevention plate 45 is prevented from being deformed or broken in the extracting operation of the terminal 26.

As described above, the front holder 22 is formed by integrally forming the upper and lower wall portions 41, 42, which are formed by sequentially connecting the excessive deformation prevention plates 45, detection plates 46 and terminal pressing plates 47, with the front wall portion 43 which sequentially connects the front face sides of the upper and lower wall portions 41, 42. The front holder 22 itself is strengthened according to such an integral forming and the excessive deformation prevention plate 45 forms a part of the front holder 22. Thus, the excessive deformation prevention plate 45 is also provided with sufficient strength.

Further, as shown in FIGS. 7, 8, 9 and 11, the guide ribs 60 are formed at both sides of the terminal pressing plate 47 in each of the upper and lower wall portions 41, 42, and, as shown in FIGS. 5, 6, 12 and 13, the guide grooves 38 into which the guide ribs 60 are slidably inserted are formed in the housing 21. Accordingly, since the guide ribs 60 slide along the guide grooves 38, the front holder 22 can slide stably. Further, since the guide ribs 60 are supported by the guide grooves 38, the excessive deformation prevention plate 45 as a part of the upper or lower wall portion 41, 42 is supported at its both sides by the housing 21. In this manner, since the excessive deformation prevention plate 45 is not only supported at its tip portion 45*a* by the insertion hole 39 but also supported at its both sides by the guide ribs 60 and the guide grooves 38, the excessive deformation prevention plate 45 is in an entirely and fixedly supported state. As a consequence, the excessive deformation prevention plate 45 is prevented from being deformed even when an excessive stress is applied thereto and so the excessive deformation of the locking arms 35 can be surely prevented.

Further, since the excessive deformation prevention plates 45 of the upper and lower wall portions 41, 42 are coupled by the sliding arm 55 and the excessive deformation prevention plates 45 disposed adjacently to the transversal or horizontal direction are coupled by the coupling arm 56, all the excessive deformation prevention plates 45 are mutually coupled by the sliding arms 55 and the coupling arms 56. Since the entire strength of the excessive deformation prevention plates 45 are reinforced from one another due to such a coupling, the excessive deformation prevention plates 45 are prevented from being deformed accidentally by a stress applied thereto.

Then, the assembling operation of the connector according to the embodiment will be explained. The outer side wall portions 27 of the housing 21 are inserted into the sliding arms 55 of the front holder 22, then the front holder 22 is slid to the rear side. In this case, since the guide ribs 60 of the front holder 22 slide along the guide grooves 38 of the housing 21, the sliding operation can be performed stably. According to this sliding operation, the front holder 22 can be assembled at the provisionally locking position with respect to the housing 21, as shown in FIGS. 1, 2 and 14.

Figure 1:
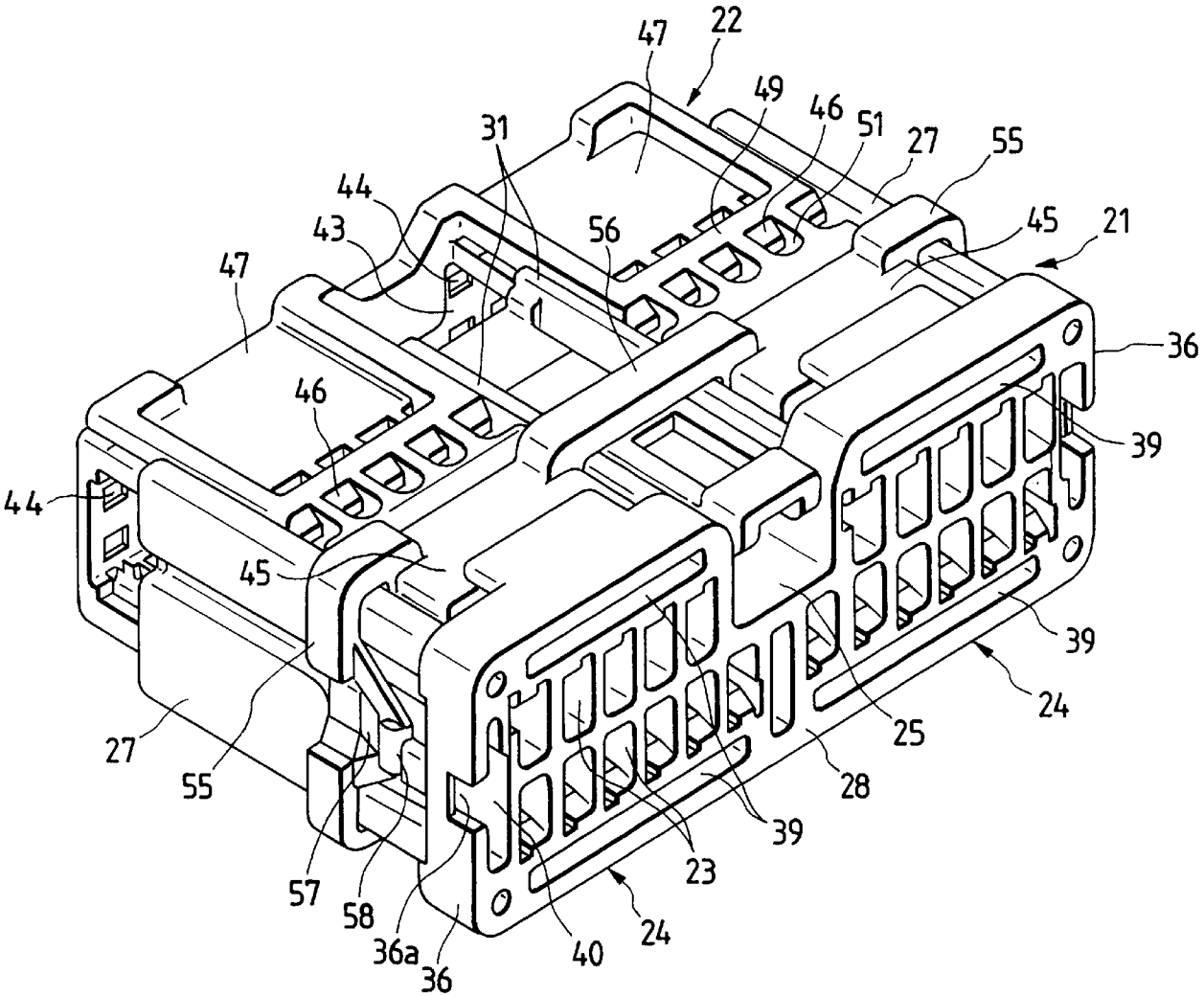
FIG. 1 is a perspective view of a connector according to an embodiment of the present invention showing the provisionally locking state of a front holder thereof seen from the rear side thereof.
Figure 2:
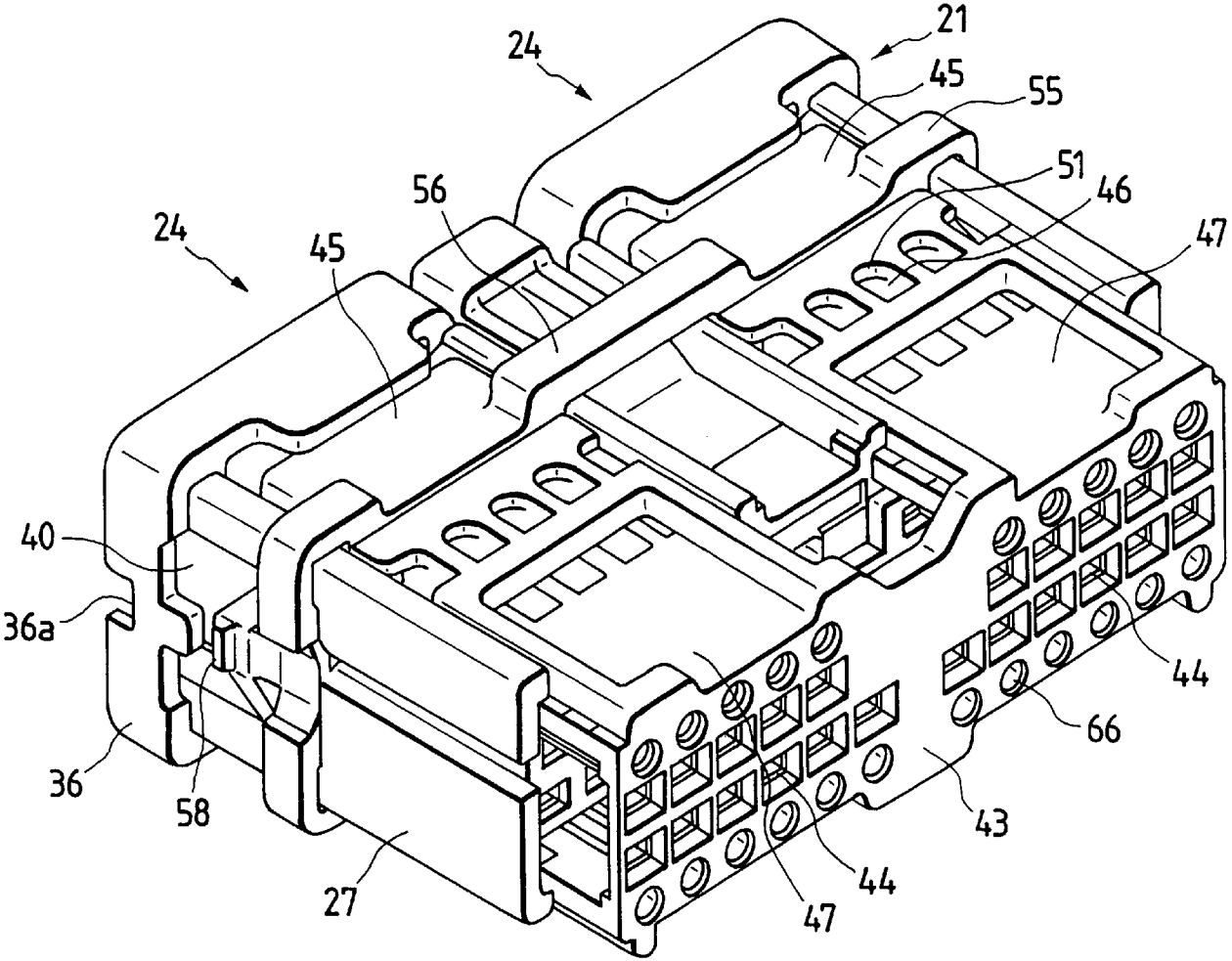
FIG. 2 is a perspective view of the front holder showing the provisionally locking state thereof seen from the front side thereof in the connector according to the embodiment of the present invention.

In this provisionally locking position, as shown in FIGS. 1 and 2, the stopper portions 57*b* of the locking arms 57 abut against the abutment portions 37 formed at the outer side wall portions 27 of the housing 21. According to this abutment, the front holder 22 is prevented from being drawn back from the provisionally locking position, so that the front holder 22 can be assembled to the housing 21 stably.

In the state where the front holder 22 is positioned at the provisionally locking position in this manner, the terminals 26 connected to the covered wires 64 are inserted into the terminal storage chambers 23 from the rear side.

After the insertion of the terminals 26, the front holder 22 is further slid to the rear side thereby to engage the locking arms 57 with the locking grooves 36*a* formed at the locking frames 36 of the housing 21. According to this engagement, the front holder 22 is fixed at the formally locking position as shown in FIGS. 3 and 4.

In the state where the front holder 22 is fixed at the formally locking position, as shown in FIG. 15, the communicating holes 30 of the housing 21 communicate with the terminal insertion holes 44 of the front holder 22. Thus, the partner-side terminals (not shown) can proceed into the terminal storage chambers 23, so that it becomes possible to connect the partner-side terminals with the terminals 26.

In the sliding operation of the front holder to the formally locking position, in the case where the terminal 26 is completely inserted into the terminal storage chamber, the locking arm 35 engages with the rear side of the contact portion 61 of the terminal 26 and so is prevented from being deformed outside, so that the detection plate 46 makes the locking arm 35 slide smoothly. Each of the detection plates 46 has the step portion and protrudes towards the corresponding locking arm 35, so that the detection plates 46 occupy the bending deformation spaces 48 of the locking arms 35, as shown in FIG. 15. The detection plates 46 may be arranged in a manner that the bottom walls thereof press the locking arms 35 from the outside. Accordingly, since the locking arms 35 can not be released from the locking state with the terminals 26, the terminals 26 can be surely fixed within the terminal storage chambers 23.

In contrast, when the terminal 26 is semi-inserted or not completely inserted into the terminal storage chamber, the locking arm 35 can not engage with the contact portion 61 of the terminal 26 in a good condition and so the locking arm 35 deviates outside. In this state, since the detection plate 46 having the step portion 50 and protruding towards the corresponding locking arm 35 abuts against the locking arm 35, the front holder 22 can not be slid. Accordingly, the incomplete insertion of the terminal 26 can be detected.

In the case of extracting the terminal 26 from the connector in the aforesaid state, the engagement state between the locking frame 36 and the locking arm 57 is released, and then the front holder 22 is slid and restored to the provisionally locking position. In this provisionally locking position, since the excessive deformation prevention plate 45 covers the locking arms 35 from the outside so as to have the bending deformation space 48 therebetween as shown in FIG. 14, it is possible to insert the drawing jig 52 into the space through the opening window portion 51 to bend the locking arm 35 outside. When the locking arm 35 is bent in this manner, the locking arm 35 can be released from the engagement state with the terminal 26. As a result, the terminal 26 can be extracted from the housing 21.

In this case, since the excessive deformation prevention plate 45 covers the locking arms 35 and further the excessive deformation prevention plate 45 is not deformed itself as described above, the excessive deformation of the locking arms 35 can be prevented. Thus, the locking arms 35 are prevented from being bent excessively even if an excessive stress is applied to the locking arms 35, so that the locking arms 35 are prevented from being subjected to the plastic deformation or breakage.

As described above, according to the present invention, since the tip portion of the excessive deformation prevention plate 45*a* is supported by the insertion hole 39 upon insertion of the tip portion of the excessive deformation prevention plate into the insertion hole of the housing, the excessive deformation prevention plate is prevented from being deformed even if an excessive stress is applied to the locking arm at the time of bending the locking arm. Thus, the excessive deformation of the locking arm can be surely prevented, and so the terminal can be held stably even when the connector has a simplified structure not necessary for adding any new member.

According to the present invention, since the excessive deformation prevention plate 45 is inserted into the insertion hole 39 when the front holder is positioned at the provisionally locking position, the deformation of the excessive deformation prevention plate can also be prevented from the start of the sliding operation of the front holder to the termination thereof. Further, even if the locking arm is bent when the front holder is disposed at the provisionally locking position, the excessive deformation of both the excessive deformation prevention plate and the locking arm can be prevented.

According to the present invention, since the front holder having the excessive deformation prevention plates is provide with a sufficient strength and the guide ribs are supported by the guide grooves when slide therealong, the excessive deformation prevention plates are prevented from being deformed to the extent more than needed even if an excessive stress is applied thereto.

According to the present invention, since the upper and lower wall portions are coupled by the sliding arm, the excessive deformation prevention plates is provide with a sufficient strength and hence the excessive deformation prevention plates are prevented from being deformed to the extent more than needed.

What is claimed is:

1. A connector comprising:

at least one locking arm of a housing which engages a terminal inserted into at least one terminal storage chamber of said housing thereby preventing said terminal from being released therefrom;

a front holder which slides into said housing from a front side of said housing and attaches to said housing;

at least one excessive deformation prevention plate of said front holder which extends along a side of said locking arm to prevent excessive deformation of said locking arm; and at least one insertion hole, provided in said housing, which slidably receives a tip portion of said excessive deformation prevention plate therein to support said excessive deformation prevention plate.

2. The connector according to claim 1, wherein said tip portion of said excessive deformation prevention plate is inserted into said insertion hole of said housing both while said front holder is positioned at a provisionally locking position and a formally locked position.

3. The connector according to claim 1, wherein said front holder is formed in a U-shape defined by upper and lower wall portions, said wall portions formed by said excessive deformation prevention plate and a terminal pressing plate for pressing said terminal within said terminal storage chamber, and by a front wall portion for covering a front face of said housing.

4. The connector according to claim 2, wherein said front holder is formed in a U-shape defined by upper and lower wall portions, said wall portions formed by said excessive deformation prevention plate and a terminal pressing plate for pressing said terminal within said terminal storage chamber, and by a front wall portion for covering a front face of said housing.

5. The connector according to claim 3, wherein said at least one excessive deformation prevention plate is two or more excessive deformation prevention plates and wherein said front holder has a sliding arm which couples said excessive deformation prevention plates of said upper and lower wall portions and slides along an outer wall of said housing.

6. The connector according to claim 4, wherein said at least one excessive deformation prevention plate is two or more excessive deformation prevention plates and wherein said front holder has a sliding arm which couples said excessive deformation prevention plates of said upper and lower wall portions and slides along an outer wall of said housing.

7. The connector according to claim 1, wherein the locking arm and said housing are a single piece.

8. The connector according to claim 3, wherein said front holder further includes guide ribs at edges of said upper and lower wall portions, and said guide ribs are slidably inserting into guide grooves provided in said housing.

9. The connector according to claim 4, wherein said front holder further includes guide ribs at edges of said upper and lower wall portions, and said guide ribs are slidably inserting into guide grooves provided in said housing.

10. The connector according to claim 2 having a terminal pressing plate which abuts against an outwardly portion of said locking arm when said front holder is positioned in said formally locked position.

11. The connector according to claim 4 having a terminal pressing plate which abuts against an outwardly portion of said locking arm when said front holder is positioned in said formally locked position.

12. The connector according to claim 1 wherein said terminals are inserted into said terminal storage chamber from a rear side of said housing, opposite a front side of said housing in which said front holder is received.

* * * * *